US005236349A

United States Patent [19]

Fabris

[11] Patent Number: 5,236,349

[45] Date of Patent: Aug. 17, 1993

[54] TWO-PHASE REACTION TURBINE

[76] Inventor: Gracio Fabris, 2039 Dublin Dr., Glendale, Calif. 91206

[21] Appl. No.: 960,018

[22] Filed: Oct. 13, 1992

Related U.S. Application Data

[63] Continuation-in-part of Ser. No. 601,911, Oct. 23, 1990.

[51] Int. Cl.[5] ..... F01D 1/18

[52] U.S. Cl. ..... 415/80; 415/81; 415/211.1; 415/211.2; 210/188; 210/512.1; 210/789; 96/214

[58] Field of Search ..... 415/80-81, 415/83, 84, 86, 202, 208.2, 208.3, 211.1, 212.1; 55/203, 404, 405; 210/188, 512.1, 789

[56] References Cited

U.S. PATENT DOCUMENTS

| | | | |
|---|---|---|---|
| 2,063,194 | 12/1936 | Roy | 415/198.1 |
| 3,621,667 | 11/1971 | Mokadam . | |
| 3,799,243 | 3/1974 | Castillo . | |
| 3,879,949 | 4/1975 | Hays et al. . | |
| 3,972,195 | 8/1976 | Hays et al. . | |
| 4,332,520 | 6/1982 | House | 415/80 |
| 4,336,039 | 6/1982 | Sohre | 415/80 |
| 4,438,638 | 3/1984 | Hays et al. . | |
| 4,881,872 | 11/1989 | Bütikofer et al. | 415/209.1 |
| 5,046,919 | 9/1991 | Wulf . | |

FOREIGN PATENT DOCUMENTS

| | | | |
|---|---|---|---|
| 46944 | 5/1889 | Fed. Rep. of Germany | 415/80 |
| 2122849 | 11/1972 | Fed. Rep. of Germany | 415/80 |
| 213973 | 9/1984 | Fed. Rep. of Germany | 415/80 |
| 2335135 | 7/1977 | France | 415/80 |
| 603487 | 4/1960 | Italy | 415/80 |

OTHER PUBLICATIONS

"Performance Tests of the Radial Outflow Reaction Turbine For Geothermal Applications", Lawrence Livermore Laboratory, Aug. 21, 1978.

NASA Technical Report 32-987, "Acceleration of Liquids in Two-Phase Nozzles", Jul. 1, 1968, pp. 1-43.

"Evaluation of a Two-Phase Turbine for Solar Electric Power Generation", Biophase Energy Systems, Nov. 21, 1979.

Chemical Engineering progress, Jul. 1972, "Turboexpanders and Processes That Use Them", J. S. Swearingen.

NASA Tech Briefs, Nov. 1991, "Two-Phase Hero Turbine With Curved Nozzles", Gracio Fabris.

*Primary Examiner*—Edward K. Look
*Assistant Examiner*—Christopher Verdier
*Attorney, Agent, or Firm*—Lyon & Lyon

[57] ABSTRACT

A radially outward flow turbine having a rotor with nozzles which extend from an inner inlet passage to the rotor periphery with a substantially constant pressure drop per unit length of nozzle, with a first order surface continuity along the surface of each nozzle and with a nozzle profile which allows two-phase flow without substantial lateral acceleration according to the following formula:

$$\frac{w^2}{\rho} + \frac{u^2}{R}\cos\alpha - \frac{2uw}{R} = 0.$$

The turbine is also illustrated with a second set of nozzles outwardly of the first set included in either the rotor or in a second contrarotating rotor. The rotor in either case vents steam to multiple steam turbine stages while the second set of nozzles receives saturated vapor. The steam turbine stage may be defined by either the first rotor and a stator or the first rotor and a contrarotating rotor.

6 Claims, 7 Drawing Sheets

TWO-PHASE REACTION TURBINE

This is a continuation-in-part of U.S. application Ser. No. 07/601,911 filed Oct. 23, 1990.

BACKGROUND OF THE INVENTION

The field of the present invention is radially outward flow turbines.

Two-phase turbines have long been contemplated as needed in a wide variety of applications, both terrestrial and space. The ability to handle two-phase flow would allow such devices to be coupled directly to a source of pressurized fluid containing or flashing to contain both a liquid phase and a gas phase. Thus, the primary fluid in a number of applications would constitute the working fluid for the turbine. Examples of such fluids are geothermal brine and hydrocarbons with dissolved gas. Presently, without the availability of an effective two-phase turbine, such fluids are simply throttled with a total waste of extractable mechanical energy. It is contemplated that practical two-phase turbines would find substantial utility in open or closed energy conversion cycles. They could be used as a key element in topping or bottoming cycles. There are also many possible special applications of two-phase turbines as well. Examples include flashing of geothermal brine and boiler blowdowns.

The theoretical thermal efficiencies of two fluid component, two-phase systems approach the Carnot cycle efficiencies due to reheat of vapor by the liquid phase during expansion. This potentially means that considerably more mechanical or electrical energy can be generated from the same thermal energy from a heat source. Even for single component, two-phase turbine systems, the thermal efficiencies are higher than for comparable conventional Brayton or Rankine cycles.

In order to realize the full energy conversion potential of a two-phase turbine, it is necessary to design such a turbine having high turbine efficiency. In most of the development work on two-phase turbines in the past, substantial mechanical flow energy losses were experienced within such two-phase turbines. Demonstrated turbine efficiencies were at best in the range of 40%–45% for long-lasting devices. In the case of two-phase flow impinging on blades of a conventional axial flow steam turbine, efficiency of up to 52.4% was measured. However, blade erosion was prohibitive, severely limiting turbine life.

Extensive experimental investigation of the performance of a two-phase reaction turbine (Hero type turbine) as shown in FIG. 1 has been conducted. Saturated hot water was introduced into the rotor through a hollow shaft 2. The saturated water then flowed radially outwardly through passages 3 and was flashed through straight, short DeLaval nozzles tangentially to the rotor. The DeLaval nozzles consisted of two parts, a very short liquid converging nozzle 4 and a longer straight diverging two-phase nozzle 5. At the end of the liquid nozzle a discontinuous enlargement 6 of two to three times the cross-sectional area of the nozzle was used. At a top speed of 8066 RPM, the best measured turbine efficiency was 33% with this device. Calculations suggest that the efficiency of the DeLaval nozzles of this device were only 46%. If the nozzle efficiency was 80%, and 70% of the existing kinetic energy was recovered, then the turbine efficiency would have been 75%. If such efficiencies could be achieved, two-phase turbines would become very competitive for many applications.

In rotating stepped DeLaval nozzles such as illustrated in FIG. 1, severely delayed flashing has been found to occur. That is, as the saturated liquid travels from the center toward the outer radial edge of the rotor it becomes highly subcooled due to a very large pressure increase (about 100 atmospheres), caused by the very substantial centrifugal accelerations of the order of several thousand g's. Flashing of highly subcooled liquid through very short nozzles yields low efficiency in such cases. Vapor nucleation sites are too small and do not have enough time to grow while the liquid passes quickly through the short converging part of the nozzle.

Another inefficiency of such devices as illustrated in FIG. 1 is the existence of large lateral accelerations (on the order of multiple thousands of g's). This extreme lateral acceleration tends to separate the two phases and drastically increase the velocity slip loss. The slip loss is the loss of nozzle efficiency due to the vapor moving faster than the liquid.

U.S. Pat. No. 4,332,520 to House discloses a two-phase reaction turbine. The features of this turbine fail to address the major problems of lateral phase separation and abrupt flashing. The patent teaches a decrease of kinetic energy losses of the discharge. This is achieved by decreasing rotational speed of the reaction turbine rotor. The rotor, acting through a mechanical gear, drives a liquid pump which is located coaxially with the reaction turbine rotor. A pump acts to increase velocity of the liquid before it is injected into the reaction turbine rotor, presumably to decrease the inlet losses.

U.S. Pat. No. 4,336,039 to Sohre discloses a turbine into which two-phase, single component saturated fluid (such as geothermal brine) is introduced. The turbine rotor first separates the two phases by means of centrifugal forces generated through induced rotational motion of the fluid. Subsequently, saturated liquid and steam are expanded through separate reaction nozzles carried by the same single turbine rotor. Separation and throttling of two-phase fluid is common practice in geothermal power plants but extraction of mechanical energy from saturated flashing liquid is not. Recovery of mechanical energy from saturated flashing liquid causes severe erosion of conventional turbine blades. Also, such devices have very poor efficiency.

German Patent No. 213,973 to Jonas discloses a two-phase flow reaction turbine much like that illustrated in FIG. 1. A very short nozzle at the rotor outer radius is also disclosed in this reference and the design is believed to be of low efficiency.

SUMMARY OF THE INVENTION

The present invention is directed to a reaction turbine efficiently accommodating two-phase flow.

In a first aspect of the present invention, extended nozzles are contemplated having no substantial discontinuities in a converging diverging cross-sectional contour from near the center of a turbine rotor to its outer periphery. In this way, pressure in the nozzles drops gradually from the saturated or near saturated pressure at the hollow shaft to the discharge pressure. Abrupt flashing is avoided.

In a second aspect of the present invention, extended radially outward flow turbine nozzles are employed which are curved in such a way that the vectorial sum of all accelerations on the fluid within each nozzle has a minimal lateral component with respect to the local streamline direction of the nozzle.

In a further aspect of the present invention, staging is employed such that separation of saturated liquid and saturated vapor occurs between stages with further expansion through two-phase flow and vapor flow nozzles, respectively.

Accordingly, it is an object of the present invention to provide an improved two-phase flow turbine. Other and further objects and advantages will appear hereinafter.

DETAILED DESCRIPTION OF THE PREFERRED EMBODIMENTS

Two major problems limiting efficiency of two-phase reaction turbines encountered in the prior art are addressed in the preferred embodiments. These problems are two-phase flow separation in the rotating nozzles due to very large lateral centrifugal forces and abrupt flashing of highly subcooled liquid into two-phase flow through short nozzles.

Figure 2:
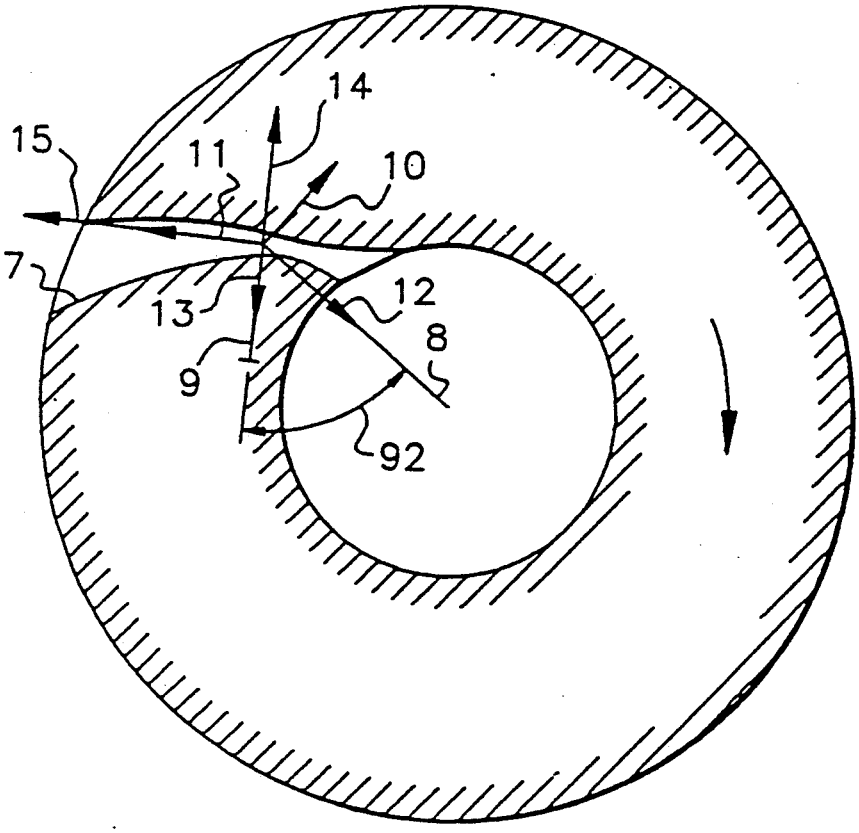
FIG. 2 is a schematic diagram illustrating vectors of accelerations experienced by fluid flowing through a curved rotating nozzle.

Nozzle 7 in FIG. 2 illustrates a rotating radially outward flow, DeLaval nozzle. Through proper curvature, no overall component of acceleration lateral to the nozzle is experienced. In such a case, separation of the phases will be minimal. FIG. 2 indicates accelerations which act on the fluid moving along the curved rotating nozzle.

The Nomenclature is as follows:

$R$(8) — is local radius of the rotor $\rho$(9) — is local radius of curvature of the rotating nozzle $u$(10) — is local tangential velocity of the rotor $w$(11) — is local relative fluid velocity inside of the rotating nozzle -continued $\frac{d}{dt}$ — is time derivative $\alpha$ — is angle between the local radius of the rotor and normal to local direction of the nozzle.

Accelerations are:

$$\text{centripetal (12)} = \frac{u^2}{R}$$

$$\text{centripetal in relative motion (13)} = \frac{w^2}{\rho}$$

$$\text{Coriolis (14)} = \frac{2uw}{R}$$

$$\text{streamwise (15)} = \frac{dw}{dt}.$$

By selecting the local radii of curvature, one can balance out the lateral accelerations all the way along the nozzle. In other words equation $$\frac{w^2}{\rho} + \frac{u^2}{R}\cos\alpha - \frac{2uw}{R} = 0 \qquad \text{(A)}$$

should be satisfied all the way along the nozzle.

Using a computer code which predicts expansion of two-phase flow in a stationary DeLaval nozzle (which is well known in the prior art) as well as is the above equation (A), a numerical iterative procedure can be devised to obtain exact shape and cross-section of the curved rotating nozzles.

Figure 3:
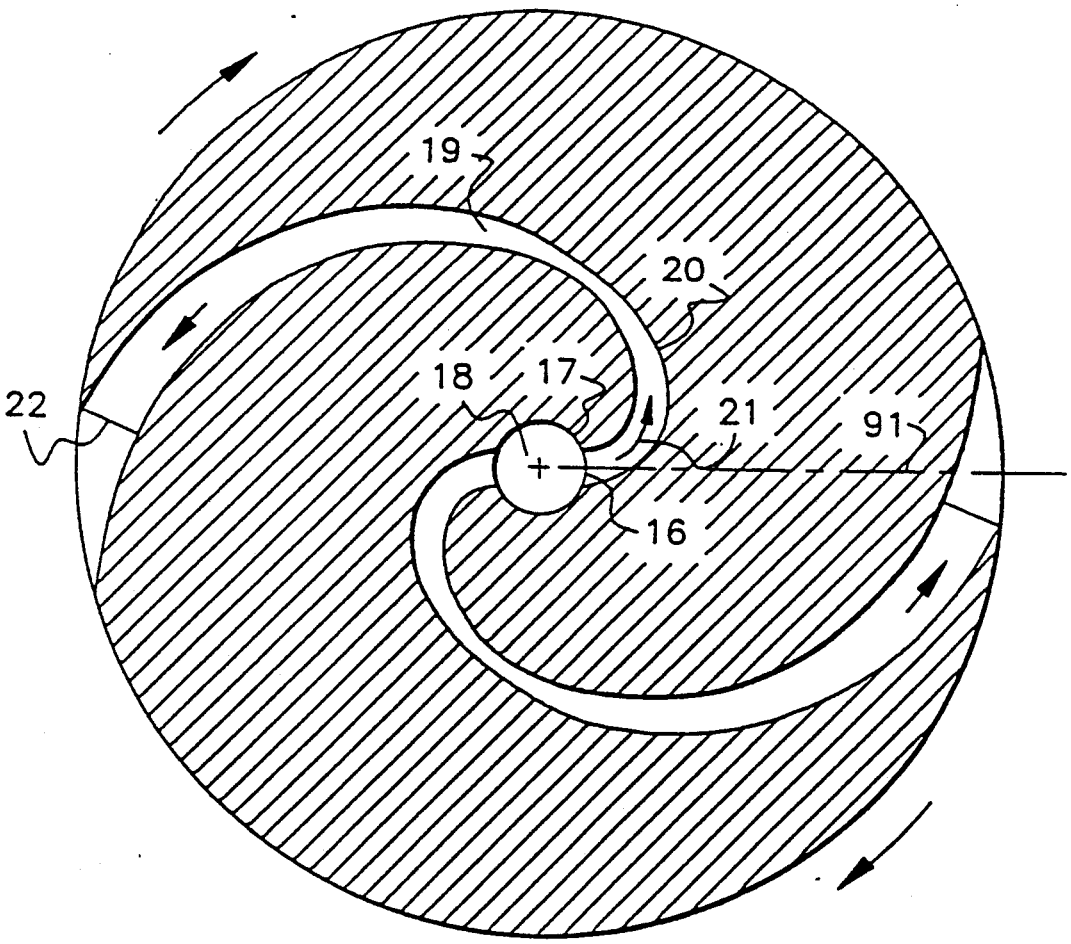
FIG. 3 is an example of a reaction turbine rotor, taken in cross section, for two-phase flow with two curved DeLaval nozzles.

A second feature is the design of curved rotating nozzles such that gradual expansion or gradual pressure drop without any rise in pressure of the stream is achieved along an extended length of the nozzle as shown in FIG. 3. In such a way, enough time is allowed for vapor nucleation sites to grow gradually so that abrupt, inefficient flashing is avoided. To achieve this result, the inlet 16 to the nozzle 19 should be placed right at the outer radius 17 of the hollow shaft 18. Pressure of the fluid in the hollow shaft 18 is at saturation pressure or slightly higher (in the order of a few PSID). After entering the nozzle 19 at its entrance 16, the fluid proceeds along the converging part 20 of the nozzle 19 as indicated by arrow 21. Line 91 indicates the radial direction of the nozzle entrance. Cross-sectional area of the nozzle 19 changes from the nozzle inlet 16 to the nozzle outlet 22 in such a way that pressure decreases approximately uniformly per unit of length along the nozzle. In this way the pressure decrease and the expansion are far more gradual than in the prior art.

Figure 1:
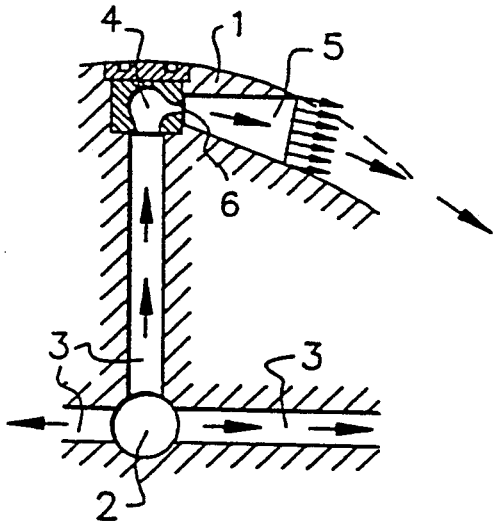
FIG. 1 PRIOR ART
FIG. 1 is a schematic diagram of a two-phase reaction turbine of a prior art design.

By starting the pressure drop in the nozzle from close to the saturation pressure, the vapor nucleation sites, i.e., miniature bubbles in the liquid, are an order of magnitude larger than in a highly subcooled liquid. The size of a vapor nucleation site is of critical importance in the dynamics of the flashing process. The size of the nucleation sites can determine if flashing is in thermodynamic equilibrium (efficient propulsive flashing) or is in non-equilibrium (abrupt inefficient propulsive flashing). The flashing fluid flowing through the nozzles 19 gradually decreases in pressure over time. The time during which this occurs is approximately two orders of magnitude longer than in the system depicted in FIG. 1.

This extended flashing also insures that the expansion is in thermodynamic equilibrium (i.e. efficient propulsive flashing).

An additional feature of the design is a method of staging within a two-phase turbine so that higher enthalpy drops can be handled per turbine. In many practical applications, the saturated liquid has more available enthalpy drop than can be handled by a single stage two-phase turbine (though two-phase turbines can handle up to ten times higher enthalpy drop per stage than steam turbines). Staging also can recover most of the kinetic energy carried by the exiting stream. In the earlier two-phase turbine concepts, staging was not solved in a neat compact design manner.

Figure 4:
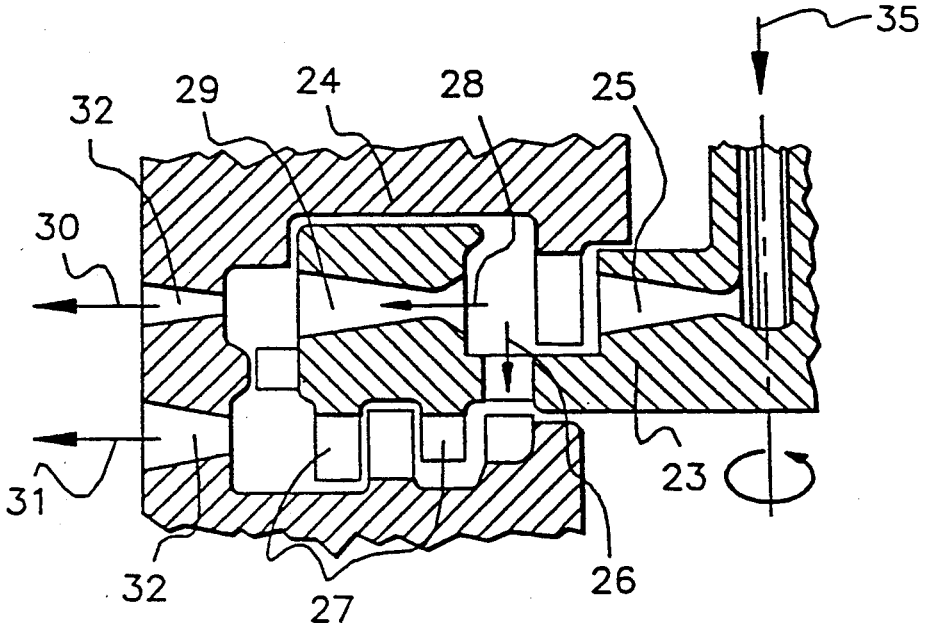
FIG. 4 is a schematic of a two-stage two-phase flow turbine with a single rotor.

FIG. 4 illustrates a two stage two-phase turbine with a single rotor 23 and a single stator 24. After flashing through the first stage 25 having nozzles according to the above construction, steam 26 separates immediately and passes through a couple of steam turbine stages 27. On the other hand the separated saturated liquid 28 is flashed again through the second stage 29 in a like set of nozzles to those of the first set of nozzles 25. Liquid 30 and vapor 31 exit through separate diffusor type passages 32 wherein some of the fluid kinetic energy is recovered and converted into increased pressure.

Figure 5:
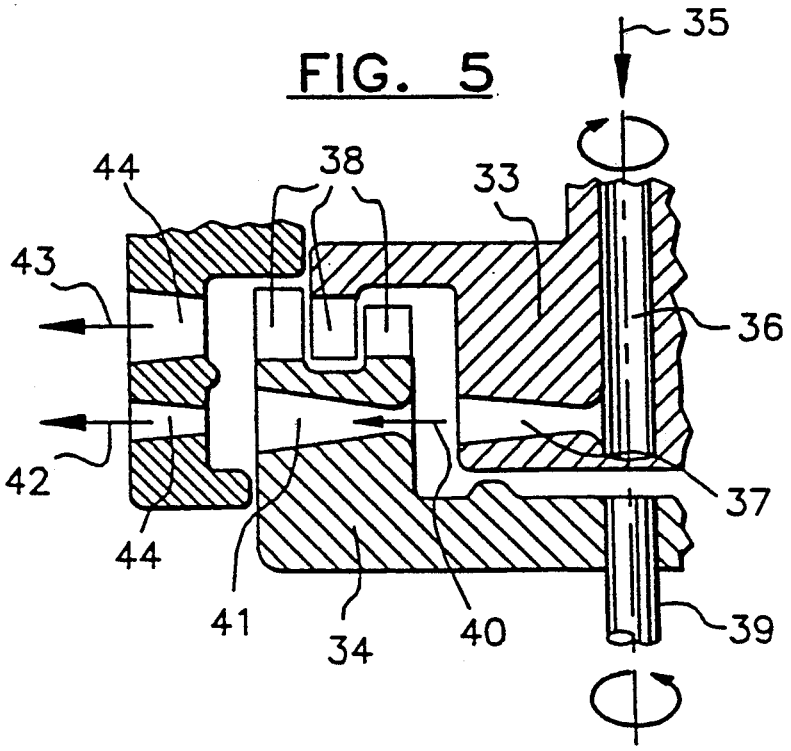
FIG. 5 is a schematic of a two-stage two-phase flow turbine with two coaxial contra rotating rotors.

FIG. 5 illustrates two stage two-phase turbines with two contrarotating rotors 33, 34. Saturated liquid 35 enters the first rotor through a hollow shaft 36 and then is flashed through the first stage nozzles 37. The vapor is then separated from the discharging two-phase flow from the first stage 37 and enters vapor blades 38 of the second stage which is on the second rotor 34. The second rotor 34 countrarotates with respect to the first rotor 33. The second rotor 34 is on its own shaft 39 which is coaxial with the hollow shaft 36 of the first rotor 33. The saturated liquid 40 separated out after discharge from the first stage 37 enters and flashes through second stage two-phase nozzles 41 which are on the second rotor 34. Liquid 42 and vapor 43 exit from stationary diffuser channels 44 which are part of the stator 45. The nozzles 37 and 41 are of like design to that of nozzles 19.

A numerical procedure has been developed to generate the shape of the rotating nozzles. Fluid particles travelling with specified velocity along the nozzle need to experience no net or minimal force component normal to the streamline. In other words there would be no or minimal separation forces acting on the liquid. As discussed earlier the constraining equation is derived from the acceleration balance (shown in FIG. 2) on a fluid particle that has relative velocity w(11) at a distance R(8) from the center of rotation. Local velocity of the rotor is u(10), and the radius of curvature of the nozzle is $\rho$(9).

The resulting equation A is repeated here $$\frac{w^2}{\rho} + \frac{u^2}{R}\cos\alpha - \frac{2uw}{R} = 0 \qquad \text{(A)}$$

If $\omega$ (46) is the angular velocity of the rotor of a turbine then there is additional equation (B)

$$u = \omega R \qquad \text{(B)}$$

relating the local rotor velocity u to the local radius $R_o$. The procedure developed is an extensive numerical iterative computer method. It starts with an assumed relative velocity (w) profile in a rotating system as a function of distance along the nozzle (measured from the nozzle inlet). This velocity (w) profile is actually obtained by running a stationary nozzle computer code for specified nozzle inlet conditions and using the resulting exit bulk velocity (Vb) in the energy equation between two points along a passage in a rotating system. The bulk velocity is defined as a local cross-sectional average fluid velocity (for both phrases) as predicted by the computer code.

Knowing w (the relative velocity) at any point, geometry and constraining equations are used to advance in small steps until the outer diameter of the rotor is met. The nozzle overall length is found at this point as well as the corresponding relative velocity. If this discharge velocity differs from what was prescribed by the stationary nozzle run, then the velocity profile is changed and iterations are continued until an agreement is reached.

The equation used to calculate the relative velocity in a rotating passage requires the value of enthalpy drop $\Delta h$ between a reference point (entrance to the nozzle) and any other point along the passage. An estimate of $\Delta h$ can be retrieved from the stationary nozzle code run converting $V_b$ at that point into the enthalpy change. For simplicity a linear velocity profile was selected with the maximum velocity at discharge $V_{bmax}$ the same as predicted by the stationary nozzle run. So, for a point N along the passage $$V_{bN} = V_{bmax}\, S_N / S_{max}$$

where $V_{bN}$ is the relative velocity at a local point N of an equivalent stationary nozzle, $S_N$ is the distance along the nozzle from the nozzle entrance to the point N and $S_{max}$ is the total length of the nozzle.

The relative velocity in the rotating nozzle, at a point equivalent to a point in a stationary nozzle, can now be calculated from equations $$w_n^2 = W_o^2 + (u_n^2 - u_o^2) + 2\Delta h_n$$

$$\Delta h_n = \tfrac{1}{2} V^2_{bn}$$

$$u_n = \omega R_n$$

where $W_o$ and $u_o$ have some known value at the reference point which is the entrance to the nozzle.

Figure 6:
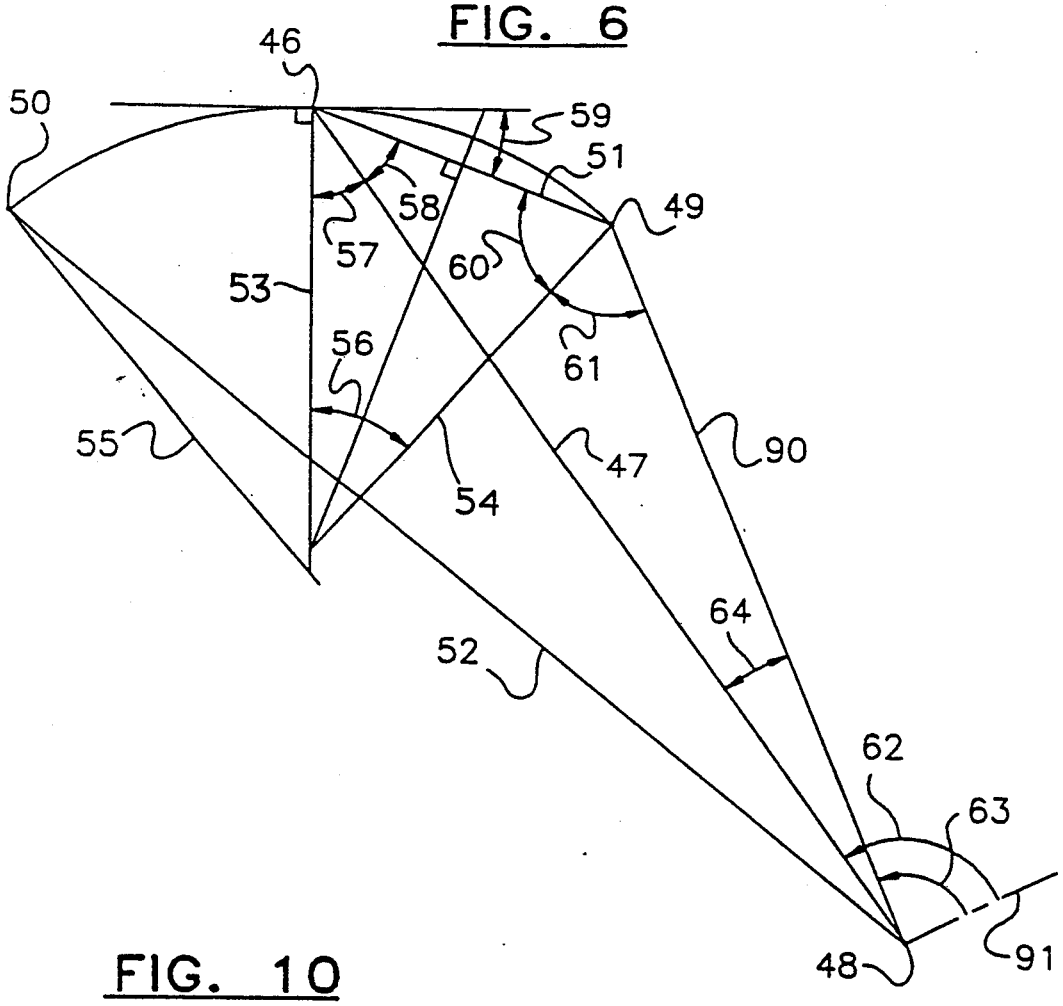
FIG. 6 is a schematic illustrating a numerical method for generating curved contours for rotating non-separation nozzles.

FIG. 6 illustrates a method for finding appropriate local radii of curvature of the rotating nozzle. Local point N(46) is on radial distance $R_n$(47) from the center 48 of the rotor. Points N-1 (49) and N+1 (50) are located at incremental distances upstream and downstream of the point N (46). The incremental distance (51) in the streamwise direction between two points (46 and 49) is denoted by $\Delta S$. The rotor radii at appropriate nozzle points are $R_n$(47), $R_{n-1}$(90) and $R_{n+1}$(52). Radii of nozzle curvature at appropriate points are $\rho_n$(53), $\rho_{n-1}$1(54) and $\rho_{n+1}$(55).

Indicated angles are $2\beta$n(56), $\alpha_n$(57), $\gamma_n$(58), $\beta_n$(59), 90-$\beta_n$(60), $\alpha_{n-1}$(61), $\theta_n$(62), $\theta_{n-1}$(63), and $\Delta\theta_n$(64). Knowing the relative velocity of the fluid along the nozzle at the upstream point N−1 (49) and solving the constraining equation for the radius of curvature an equation may be generated $$S_{N-1} = w^2_{N-1} / \{\omega(2w_{N-1} - u_{N-1}\cos\alpha_{N-1})\}.$$

Next, from the geometry of a triangle: N (46), N−1 (49), O (48), we get $$\beta_n = \mathrm{SIN}^{-1}\frac{\Delta S}{2\rho_{n-1}},$$

or for incremental ΔS, i.e. small relative to $\rho$ $$\beta_n = \mathrm{SIN}^{-1}\frac{\Delta S}{2\rho_{n-1}},$$

$R_n$ can be found from the cosine law for a tringle N (46), N−1 (49), O (48):

$$R_n=\{\Delta S^2+R^2_{n-1}-2R_{-1}\Delta S\ \mathrm{SIN}\ (\beta_n-\alpha_{n-1})\}^{\frac{1}{2}}.$$

$\theta_n$ is found from the sine law for the same triangle:

$$\Delta\theta_n = \mathrm{SIN}^{1}\left\{\frac{\Delta S}{R_n X\mathrm{COS}(\alpha_n^{-1}-\beta_n)}\right\}$$

Now, one can find $\alpha_n$ required for the next step:

$$\alpha_n=90-\gamma_n-\Gamma_n=90-\{180-[\Delta\theta_n+(90-\beta_n+\alpha_{n-1})]\}-\beta_n=\alpha_{n-1}-2\ \beta_n+\Delta\theta_n$$

then for the next step S, $\theta$ and N are increased:

$$S=S+\Delta S$$

$$\theta=\theta+\Delta\theta$$

$$N=N+1$$

and then w at the new point is evaluated.

Once the nozzle trajectory, based on a given $V_b$ profile, has been generated, the program checks agreement between the exit relative velocity prescribed and the one that was calculated at the outer radius of the rotor using the numerical routine. If a discrepancy is found a new value is assigned for the nozzle length and a new velocity profile (this time having the prescribed exit velocity at the end of the new trajectory length) is used for the next run. This scheme repeats itself until agreement is reached.

The following provides an example of the foregoing calculation. A rotor 27.0 inches in diameter with a one inch diameter shaft was assumed for the trajectory generating procedure computer runs. Also, the rotation speed was 5250 RPM, which led to a tip speed at 620 ft/sec. The fluid is saturated water at 200 PSIA expanding to 30 PSIA. Assumed flowrate was 2 lb/sec.

A stationary nozzle design computer code was run for values of Weber numbers of 2, 4, 6 and 8. The Weber number is defined as the product of vapor density, square of fluid velocity and characteristic radius of liquid droplets divided by surface tension of the liquid.

Figure 7:
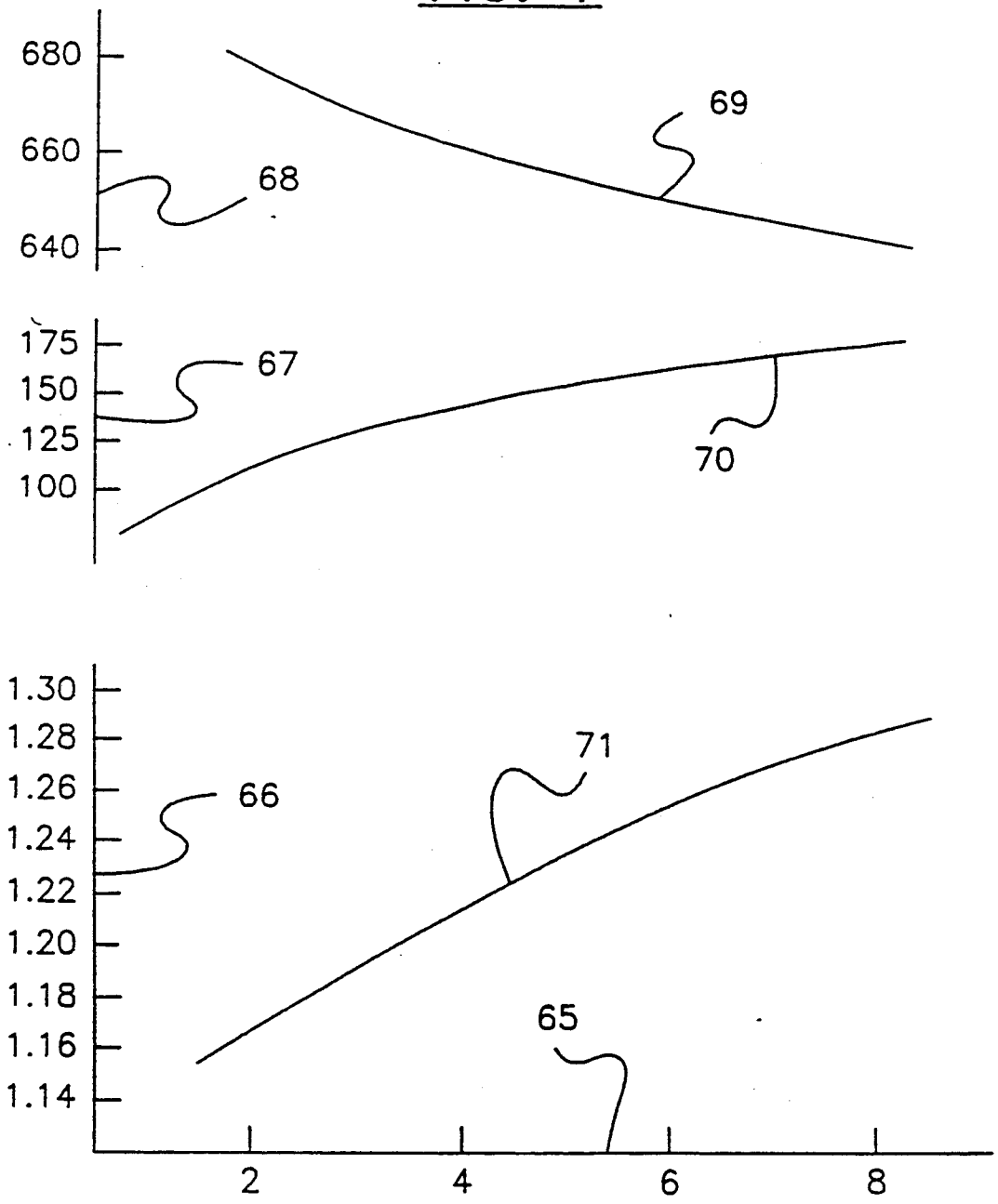
FIG. 7 is a graph of gas velocity, slip velocity and velocity slip ratio as a function of Weber number.

In FIG. 7, the abscissa 65 is Weber number, the ordinates are velocity slip ratio (66) $[V_gV_l]$, the slip velocity $[V_g/V_l]$ (67), and the gas velocity $V_g$ (68). Indicated curves are the nozzle discharge velocities of gas $V_g$ (69), the slip velocity $[V_g-V_l]$ (70), and the velocity slip ratio $[V_g/V_l]$ (71).

Figure 8:
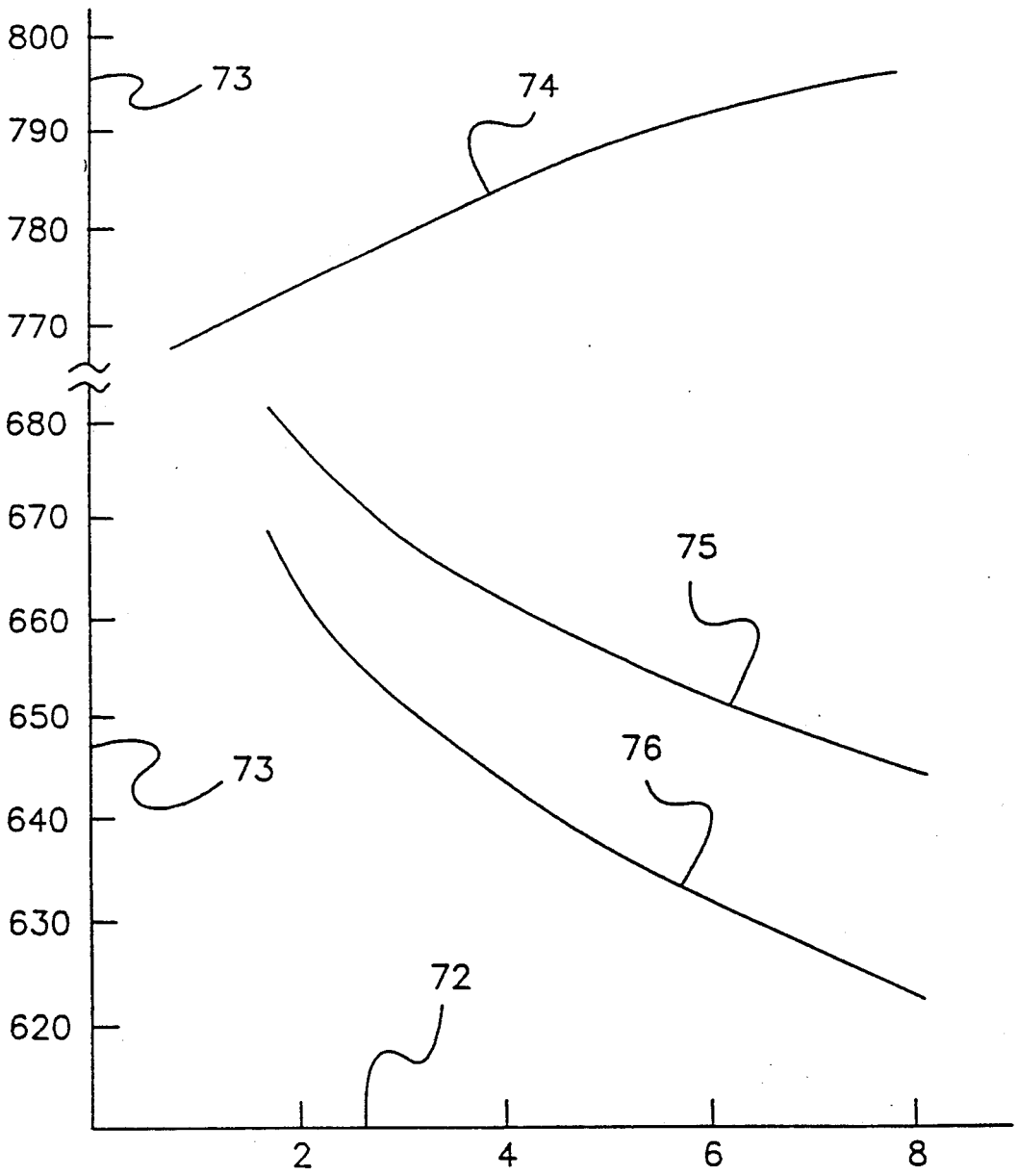
FIG. 8 is a graph of gas velocity, bulk velocity and liquid velocity as a function of Weber number.

In FIG. 8, the abscisa 72 is Weber number, the ordinate 73 is for individual velocities. The indicated curves are for discharge: the gas velocity $V_g$ (74), the bulk velocity $V_b$ (75) and the liquid velocity $V_l$ (76).

In order to examine the effect of the slip, three slip values were examined. The exit slip velocities $[V_g-V_l]$ were 109.2 ft/sec (base case corresponding to Weber number of two), 120.12 ft/sec (corresponding to +10% increase in slip) and 131.0 ft/sec (corresponding to +20% increase in slip) were selected for comparison. Corresponding values of $V_b$ at the exit were selected from FIG. 7 as 678.6 ft/sec, 674 ft/sec and 668.15 ft/sec.

Figure 9:
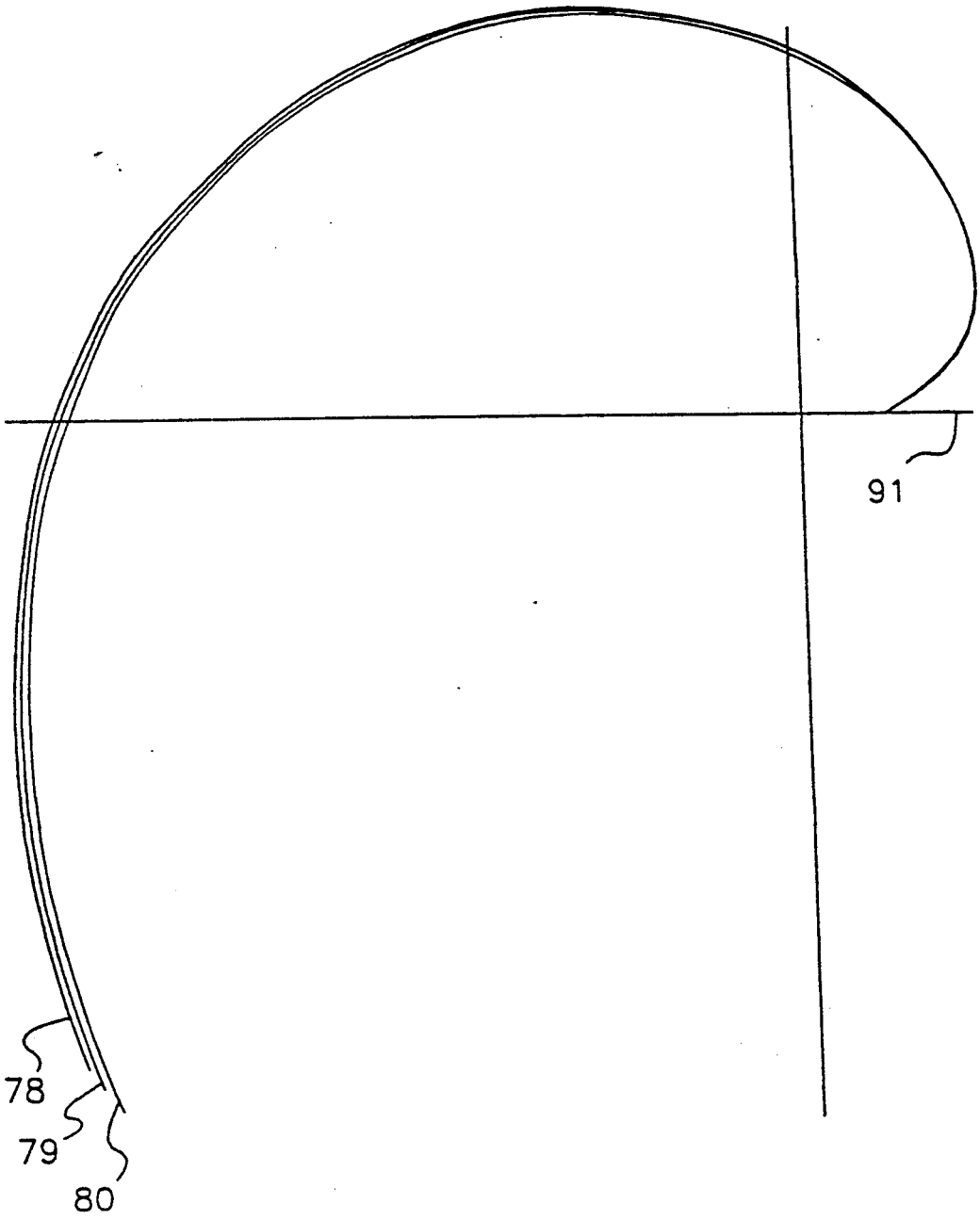
FIG. 9 is a curved nozzle for different values of gas to liquid velocity slip ratios.

Three different linear $v_b$ velocity profiles along the nozzles based on these values were constructed and used in the numerical procedure to obtain the corresponding trajectories of the rotating nozzles. The results are plotted on FIG. 9. The curve 78 is the shape of the nozzle centerline for the base case. The curve 79 is the shape of the nozzle centerline for a 10 percent increase in the slip velocity. The curve 80 is the shape of the nozzle centerline for a 20 percent increase in the slip velocity. It is obvious that an error in prediction of the velocity slip ratio makes an almost negligible effect on the shape of the rotating nozzles. This means that the efficiency of the nozzles is going to be good and almost insensitive to reasonable changes of the slip velocity.

The entrainment of the liquid boundary layers has important influence on two-phase nozzle flow stability and flatness of efficiency curves. Analysis indicates that in the properly curved rotating nozzles, entrainment of the liquid boundary layers by faster moving core flow will be more efficient than in the stationary nozzles. This will help to maintain a homogenous two-phase flow pattern.

Figure 10:
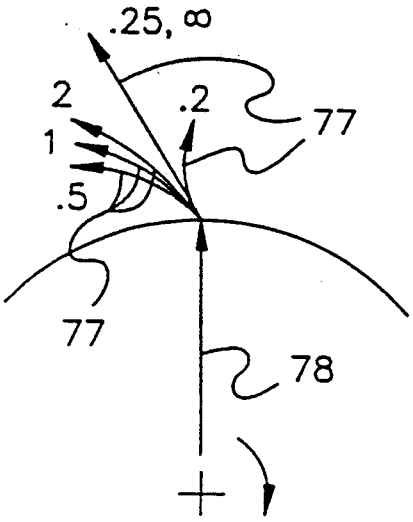
FIG. 10 is a diagram of curves of relative motion for initial flow perpendicular to the rotor radius as a function of a ratio of relative velocity and rotor velocity.
Figure 11:
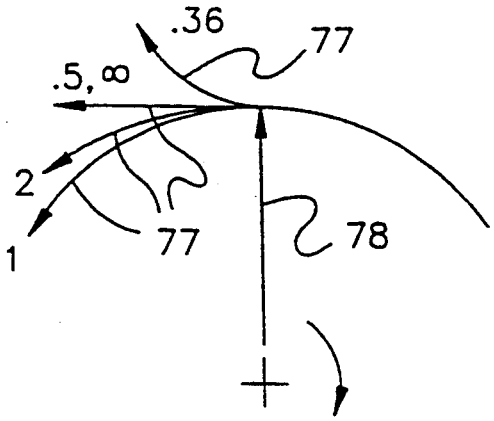
FIG. 11 is a diagram of curves of relative motion for initial flow at 30° with respect to rotor radius as a function of ratio of relative velocity and rotor velocity.

FIGS. 10 and 11 illustrate curving of the relative fluid motion with respect to a rotating disc. In other words, curves 77 are pathlines of relative motion experienced by an unconfined fluid (assumes no nozzle walls) which has a given initial relative velocity and direction. Numbers written next to the curves 77 are ratios (w/u) of the relative velocity and the local tangential velocity of the rotor. It has to be kept in mind that in turbines the bulk of the fluid in the nozzles always has a w/u ratio larger than one (usually about 1.1 to 1.2).

In FIG. 10, the initial direction of the relative motion is at thirty degrees with respect to the direction of the local rotor radius 78. The condition of no separation indicates that only liquid which is moving at $w/u>0.25$ might be forced toward the right wall. However that liquid boundary layer is at the same time exposed to a much faster moving core stream ($w/u=1.1$) which accelerates the liquid boundary layer surface to a velocity higher than $w/u=0.25$ as well as creates waves and separate droplets via Kelvin-Helmholtz instability. As soon as any particle of liquid is accelerated to $w/u>0.25$, it will become part of the core flow and will be broken up into smaller droplets. It appears that this entrainment mechanism would work more effectively here than in the case of stationary nozzles. One reason is higher core velocity and the other is the just described characteristic of the lateral acceleration as a function of w/u. Similar analysis of the liquid boundary layer on the left wall shows that it will be entrained at low as well as at high velocities. The result will be very thin liquid boundary layers and fine-droplet core flow in these appropriately curved rotating nozzles.

While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A reaction turbine comprising a radial outward flow rotor having a plurality of first nozzles each satisfying the equation:

$$\frac{w^2}{\rho} + \frac{u^2}{R}\cos\alpha - \frac{2uw}{R} = 0$$

where:

w represents a local relative velocity of fluid with respect to said rotor, $\rho$ represents a local radius of curvature of each said first nozzle, u represents a local tangential velocity of said rotor containing said first nozzles, $\alpha$ represents an angle between a radius vector and a normal to a curved centerline of each said first. nozzle, and R represents a radial distance from the center of said rotor to a point on the curved centerline.

2. The reaction turbine of claim 1 wherein said rotor has a central inlet passage and a circular periphery, each said first nozzle having an inlet at said central inlet passage and an outlet at said circular periphery, there being no first order surface discontinuities in the surface of each said first nozzle between said inlet and said outlet thereof.

3. The reaction turbine of claim 2 wherein each said first nozzle is a DeLaval nozzle.

4. The reaction turbine of claim 2 wherein each said first nozzle has variations in cross-sectional area to provide substantially uniform pressure decrease per unit length from said inlet to said outlet.

5. A reaction turbine comprising a radial outward flow rotor having a plurality of first nozzles, a plurality of second nozzles and a passageway extending axially of said rotor from between said plurality of first nozzles and said plurality of second nozzles, said plurality of second nozzles being radially outwardly of and aligned axially of said rotor with said plurality of first nozzles, each of said first and second nozzles satisfying the equation:

$$\frac{w^2}{\rho} + \frac{u^2}{R}\cos\alpha - \frac{2uw}{R} = 0$$

where:

w represents a local relative velocity of fluid with respect to said rotor, $\rho$ represents a local radius of curvature of each said first nozzle, u represents a local tangential velocity of said rotor containing said first nozzles, $\alpha$ represents an angle between a radius vector and a normal to a curved centerline of each said first nozzle, and R represents a radial distance from the center of said rotor to a point on the curved centerline;

a stator about said rotor, said stator and said rotor including at least one steam turbine stage extending radially outwardly from said passageway.

6. A reaction turbine comprising a radial outward flow first rotor having a plurality of first nozzles;

a radial outward flow second rotor contrarotating with said first rotor and having a plurality of second nozzles; a passageway extending axially of said first and second rotors from between said plurality of first nozzles and said plurality of second nozzles, said plurality of second nozzles being radially outwardly of and aligned axially of said first rotor with said plurality of first nozzles, said first rotor and said second rotor including at least one steam turbine stage extending radially outwardly from said passageway, each of said first and second nozzles satisfying the equation:

$$\frac{w^2}{\rho} + \frac{u^2}{R}\cos\alpha - \frac{2uw}{R} = 0$$

where:

w represents a local relative velocity of fluid with respect to said first rotor, $\rho$ represents a local radius of curvature of each said first nozzle, u represents a local tangential velocity of said first rotor containing said first nozzles, $\alpha$ represents an angle between a radius vector and a normal to a curved centerline of each said first nozzle, and R represents a radial distance from the center of said first rotor to a point on the curved centerline.

* * * * *